US005864968A

United States Patent [19]

Mann

[11] Patent Number: 5,864,968

[45] Date of Patent: Feb. 2, 1999

[54] SHOE WITH PERFLUOROPOLYETHER INSOLE

[76] Inventor: Morris A. Mann, 21663 W. 57th Ave., Glendale, Ariz. 85308

[21] Appl. No.: 812,651

[22] Filed: Mar. 7, 1997

[51] Int. Cl.[6] ..... A43B 13/20

[52] U.S. Cl. ..... 36/29; 36/44

[58] Field of Search ..... 36/28, 29, 35 B, 36/153, 44

[56] References Cited

U.S. PATENT DOCUMENTS 4,227,320 10/1980 Borgeas .
5,663,127 9/1997 Flynn et al. .

*Primary Examiner*—Ted Kavanaugh
*Attorney, Agent, or Firm*—Seed and Berry LLP

[57] ABSTRACT

A shoe with an improved cushioning insole containing perfluoropolyether. The perfluoropolyether resists breakdown, extending the useful life of both the insole and the shoe. Preferably, the insole contains both low- and high-viscosity perfluoropolyethers as well as a gas to enhance shock-absorbing capabilities.

19 Claims, 1 Drawing Sheet

SHOE WITH PERFLUOROPOLYETHER INSOLE

TECHNICAL FIELD

The present invention relates generally to footwear, and more particularly to a cushioning, impact-absorptive structure useful in fabricating footwear of the type having a shoe upper affixed to a sole and inserts for such footwear.

BACKGROUND OF THE INVENTION

Insoles have long been used to cushion the impact of a person's foot with a supporting surface. The basic concept of shock absorption by, for example, use of a fluid-containing insole that transfers the fluid from the heel to the ball or forward portion of the user's foot has been known for many years. Furthermore, gas-filled sacs have also been used as orthopedic cushions to replace the inner sole of shoes. To this end, gas cushions have been designed to accomplish a number of varied purposes, including to provide an orthopedically shaped surface generally conforming to the curvature of the human foot, to provide means for softening the jar incident to the operation of walking, to provide means concealed within the shoe for increasing the apparent height of a human being, to correct a manner of walking of the wearer, and to form a comfortable and natural support for the arch of the foot.

Inflated cushioning and impact-absorbing insole devices adapted for placement within articles of footwear are also known. Such devices generally have an upper layer and lower layer formed of a flexible, fluid-impermeable material, and may be filled with a fluid or gel. The upper and lower layers are sealed together, thereby forming a plurality of sealed, laterally-spaced tubular members. The volume of fluid or gel disposed within the tubular chambers may entirely or partially fill all of the chambers. Existing liquid or gels used for this purpose include those disclosed in U.S. Pat. No. 4,756,311; such as a mixture of carbopol™, propyleneglycol, formaldehyde, sodium hydroxide, color dye and water. Another fluid or gel disclosed for this purpose is that of U.S. Pat. No. 3,885,403, which comprises water, glycol and carbopol 940.

However, a significant disadvantage associated with existing fluid or gel-filled insoles is that the fluid or gel breaks down as a result of repeated use, thus significantly reducing the cushioning ability of the insole. Accordingly, there is a need in the art for a material which, when used as a component for cushioning insoles, resists breakdown over the course of normal use. The present invention fulfills this need, and provides further related advantages.

SUMMARY OF THE INVENTION

In brief, the present invention eliminates the abovementioned drawbacks by providing an article of footwear with an insole containing a material which resists breakdown after repeated use. The insole acts to cushion the impact felt by the wearer of the footwear during normal use of the same. By resisting breakdown, the material extends the useful life of both the insole and the footwear itself In the practice of this invention, the material used in conjunction with the insole is a perfluoropolyether. This material has been found to be particularly suited for this purpose by, for example, resisting breakdown after repeated and prolonged use.

In one embodiment of this invention, the cushioning characteristics of an insole employing the perfluoropolyether of this invention may be further enhanced by combining both a high viscosity and a low viscosity perfluoropolyether within a single insole. In a further embodiment, the perfluoropolyether may be employed in conjunction with a gas within a single insole to enhance the cushioning characteristics of the insole. In yet a further embodiment, a combination of a gas, a high viscosity perfluoropolyether and a low viscosity perfluoropolyether are employed in a single insole to enhance the shock-absorbing characteristics of the insole.

These and other features of the present invention will be better understood upon reference to the following detailed description, appended claims, and accompanying drawings.

DETAILED DESCRIPTION OF THE INVENTION

Figure 1:
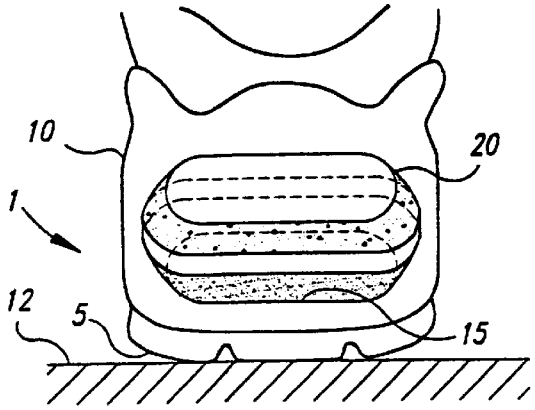
FIG. 1 is a rear view cutaway of a shoe containing a representative embodiment of an insole of this invention.

The present invention discloses an insole for an article of footwear, as well as the article of footwear itself. The insole contains a material which resists breakdown after repeated use and, more specifically, contains a perfluoropolyether. The perfluoropolyether serves to cushion the impact felt by the wearer of the footwear during walking, running and other activities for which the footwear is used. It should be understood that any insole device which employs a perfluoropolyether is within the scope of this invention. To this end, insoles are presently manufactured in a wide variety of shapes, designs and sizes to accomplish numerous purposes, and further modifications and improvements will undoubtedly be made to insoles in the future. Any such existing or future insoles may benefit from employing the perfluoropolyether material of this invention.

In the context of this invention, the term "perfluoropolyether(s)" refers to inert, perfluorinated liquid compounds having a very high concentration of "organic fluorine," but being virtually, if not totally, free of fluorine and inorganic fluorides. Included in such compounds are those referred to as perfluoropolyether, perfluorinated polyethers, or polyoxyperfluoro-alkanes and perfluoropolyethylisopropyl ether.

More particularly, the perfluoropolyethers utilizable as neat liquids or in the compositions in accordance with the present invention are compounds which contain perfluoroalkylene oxide units or perfluoroexetane rings. In particular, the repeating units of such perfluoropolyethers are chosen from the following:

(a) $—C_2F_4O—$ and $—CF_2O—$ statistically distributed along the chain;

(b) $—C_2F_4O—$ and $—C_3F_6O—$ and $—CFXO—$ (where X is —F or $—CF_3$) statistically distributed along the chain;

(c) $—C_3F_6O—$ and $—CFXO—$ (where X is —F or $—CF_3$) statistically distributed along the chain; and (d) the oxetane rings

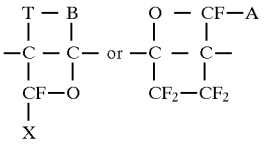

where A, B, T and X are the same or different, and individually selected from perfluoroxyalkyl, perfluoropolyoxyalkyl and perfluoroalkyl radicals.

The end groups of the perfluoropolyethers may be the same or different and are selected from the radicals —F, —$CF_3$, —$C_2F_5$, —$C_3F_7$, —Br, polar groups containing one or more electron donor atoms, and from groups containing one or more aromatic rings, including heteroaromatic rings, capable of giving rise to coordinated bonds or charge-transfer bonds.

The mean number average molecular weight of the perfluoropolyethers of this invention are generally higher than 500 and typically range from 1,000 to 10,000. The viscosity values (cSt at 20° C.) are generally in the range of from 30 to 5,000.

Representative examples of perfluoropolyethers of this invention include compounds containing the following structure:

$$CF_3O—(C_3F_6O)_m—(CFXO)_n—CF_2Y \quad (I)$$

where X and Y are independently selected from —F and —$CF_3$; m and n are integers; and the m/n ratio ranges from about 5 to about 40. These compounds and the method of preparing them are described in British Patent No. 1,104,482 (which is incorporated herein by reference in its entirety).

$$C_3F_7O—(C_3F_6O)_m—Rf \quad (II)$$

where Rf is selected from —$C_2F_5$, —$C_3F_7$, and —$CFHCF_3$; and m is an integer higher than about 2, and preferably from about 10 to about 100. These compounds and the method of preparing them are described in U.S. Pat. No. 3,242,218 (which is likewise incorporated herein by reference in its entirety).

$$CF_3O(C_3F_6O)_m(C_2F_4O)_n(CFXO)_q—CF_3 \quad (III)$$

where X is selected from —F and —$CF_3$; m, n and q are integers; m+n+q=10–300; n/q=0.5–5; and m/q+n=0.01–0.4. These compounds and the method of preparing them are described in U.S. Pat. No. 3,665,041 (which is incorporated herein by reference in its entirety).

$$CF_3O(C_2F_4O)_p(CF_2O)_q—CF_3 \quad (IV)$$

where p and q are integers alike or different from each other and the p/q ratio ranges from about 0.5 to about 1.5. Examples of these compounds and the method of preparing them are described in U.S. Pat. Nos. 3,715,378 and 3,665,041 (both of which are incorporated herein by reference in their entirety). Examples of perfluoropolyethers containing polar end groups are described in U.S. Pat. No. 3,847,978 and in Italian Patent Application Nos. 21480 A/84 and 21481 A/84 (both of which are incorporated herein by reference in their entirety).

(V) Perfluoropolyethers having an oxetane structure as described in Italian Patent Application No. 19496 A/85 (which is incorporated herein by reference in its entirety).

(VI) Perfluoropolyethers comprising —$CF_2CF_2CF_2O$— units and/or —$CF_2CF_2O$— units. These compounds may be prepared according to EP Published Application No. 148,482 and U.S. Pat. No. 4,523,039, respectively (both of which are incorporated herein by reference in their entireties).

(VII) In addition to the neutral perfluoropolyethers indicated above, perfluoropolyethers with functionalized end groups may also be employed, such as those described, for example, in European Patent Application Nos. 165,649 and 165,650, U.S. Pat. No. 3,810,874, EP Application No. 148,482, EP Application No. 151,877 and in Italian Application No. 22929 A/85 (which are all incorporated herein by reference in their entireties).

Preferred liquid perfluoropolyethers of the present invention are perfluoroethylisopropylethers and have the following chemical structure:

$$CF_3—[(O—\overset{CF_3}{\overset{|}{C}}F—CF_2)_n—(O—CF_2)_m]—O—CF_3$$

where the ratio of n/m ranges from about 20 to about 40.

These compounds are manufactured by Ausimont of Milan, Italy and sold under the tradename "Fomblin HC". Such compounds are disclosed in U.S. Pat. Nos. 4,803,067; 4,959,171 and 5,093,023 (which are all incorporated herein by reference in their entireties). Exemplars of such Fomblin HC compounds include Fomblin HC/04 (average molecular weight 1500), Fomblin HC/25 (average molecular weight 3200), and Fomblin HC/R (average molecular weight 6250). It should be appreciated that different viscosities and, to some extent, differences in other physical and chemical properties correspond to the different molecular weights, as more particularly disclosed in Table 1.

TABLE 1

| Property (Typical Value) | HC/04 | HC/25 | HC/R | Method |
|---|---|---|---|---|
| Average molecular weight | 1500 | 3200 | 6250 | PF 29/24 |
| Kinematic viscosity at 20° C. (cSt) | 40 | 250 | 1300 | ASTM D445 |
| Pour point (°C.) | −62 | −35 | −25 | ASTM D97 |
| Vapor tension (mm Hg) | $10^{-3}$ | $10^{-5}$ | $10^{-7}$ | |
| Evaporation loss (1 hr at 105° C. g/100 g) | 0.5 | 0.05 | 0.02 | ASTM D972 |
| Neutralization No. (mg K (H/g)) | 0.02 | 0.02 | 0.02 | PF 29/48 |
| Interfacial tension against water (at 20° C. dynes/cm) | 55 | 55 | 55 | PF 29/5 |
| Surface tension (at 20° C. dynes/cm) | 21 | 22 | 24 | — |
| Refractive index | 1.293 | 1.299 | 1.302 | PF 29/3 |
| Density (g/cm$^3$) | 1.87 | 1.90 | 1.91 | ASTM D891/A |

Fomblin HC fluids are generally insoluble in common ingredients used in, for example, the cosmetic and/or pharmaceutical industry. Nevertheless, Fomblin HC fluids vary from partially soluble to completely miscible with fluorocompounds, according to their molecular weights and to the fluorine content of the latter as summarized in Table 2.

TABLE 2

| Compound/Fomblin Grade | HC/04 | HC/25 | HC/R |
|---|---|---|---|
| Water | I | I | I |
| Ethanol | I | I | I |
| Glycerin | I/D | I/D | I/D |
| Glycerin (plus 5% water) | I/D | I/D | I/D |
| Diglycerin | I/E | I/D | I/D |
| Acetone | I | I | I |
| Polyethylene Glycol | I | I | I |
| Sorbeth-30 | I | I | I |
| Glyceryl Mono Distearate | I | I | I |
| Caprilic/Capric Triglyceride | I | I | I |
| Sodium Lauryl Ether Sulfate | I | I | I |
| Mineral Oil | I | I | I |
| Dimethicone | I | I | I |
| HCFC-124 | S | S | S |
| HFC-134a | S | S | SW |
| Trichloro-trifluorothane | M | M | M |
| Perfluoro-octane | M | M | M |

Key:
I: insoluble (less than 10 ppm soluble)
D: dispersible
S: soluble (more than 10% soluble)
SW: soluble warm (more than 5% soluble at 20° C.)
M: miscible A most preferred perfluoropolyether for use in this invention is Fomblin HC fluids, and in particular high-viscosity Fomblin HC/R and/or other high-viscosity perfluoropolyethers. Fomblin HC fluids, as well as the other perfluoropolyethers of the present invention, may be obtained from Ausimont of Milan, Italy or by the photo-oxidation of hexafluorapropene at low temperature. This process yields linear polymers that have a random distribution of oxyhexafluoropropene units and oxydifluoromethylene units, with a much larger proportion of the former and minor amounts of the latter, linked through ethereal bonds. Moreover, the absence of hydrogen atoms in the structure, the presence of strong covalent bonds such as C—O and C—F, and the chain ending with perfluoroalkyl groups ensure excellent chemical and thermal stability, with other useful physical properties due to the extreme flexibility of the perfluorinated polyether backbone and to the very high content of fluorine atoms (around 70%). Unlike hydrocarbons which become waxes and solids, perfluoropolyethers are liquid even at very low temperatures and beyond chain lengths of about 14 carbons.

The Fomblin HC fluids have a unique combination of properties. They are completely chemically and biologically inert. They also have low surface tensions, are thermally stable and have average molecular weights of about 1500, 3200 and 6250 (see Table 1). Moreover, they are insoluble in water and in polar and apolar solvents, excluding fluorinated solvents, but including aromatic and chlorinated solvents (see Table 2). The Fomblin HC fluids are both hydrophobic and lipophobic. In addition, the Fomblin HC fluids are Newtonian fluids and any emulsion containing these fluids is believed to become more Newtonian. Fomblin HC fluids are odorless, tasteless, colorless, non-greasy, nonvolatile, transparent liquid polymers. The absence of hydrogen and the presence of strong covalent bonds, such as the carbon-oxygen bond and carbon-fluoride bond, ensure excellent chemical and thermal stability.

The characteristics of perfluoropolyether described above make it particularly suitable for application in footwear insole devices. Perfluoropolyether gel provides the impact-absorbing characteristics required for use in insole devices. Because perfluoropolyether is particularly resistant to breakdown, its use in insole devices extends the effective life of the insole and therefore the footwear in which insole is included.

Figure 2:
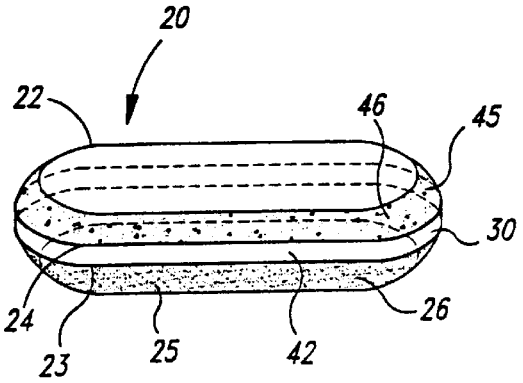
FIG. 2 is an isometric view of the insole of FIG. 1.

As shown in FIGS. 1 and 2, the footwear 1 of the present invention comprises a base 5 attached to an upper body 10. Base 5 and upper body 10 are shaped to accommodate a human foot (not shown). During normal use, such as for walking or running, upper body 10 surrounds the wearer's foot and base 5 contacts ground 12 with each of the wearer's strides. The base 5 includes cavity 15 therein, and is shaped to include insole 20. As shown in FIGS. 1 and 2, insole 20 is shaped to fit beneath the wearer's heel. However, the present invention is not so limited, and the insole may extend beneath any portion or the entire length of the wearer's foot.

The shock absorbing characteristics of perfluoropolyether are improved when high- and low-viscosity perfluoropolyethers are used in combination with a gas cushion to form a composite, cushioning insole. As used herein, high-viscosity perfluoropolyethers have a viscosity generally ranging from above 2,000 to 25,000, and typically from 6,000 to 12,000; and low-viscosity perfluoropolyethers have a viscosity generally ranging from 200 to 2,000, and typically from 500 to 1,500. In a preferred embodiment of the present invention, the insole is divided into chambers, each filled with either a gas or a perfluoropolyether.

As is best shown in FIG. 2, insole 20 includes sac 22, lower divider 23 and upper divider 24. Lower divider 23 and upper divider 24 divide sac 22 into lower chamber 25, middle chamber 30 and upper chamber 45. Lower chamber 25 is filled with high viscosity perfluoropolyether 26 and upper chamber 45 is filled with low viscosity perfluoropolyether gel 46. Middle chamber 30 is filled with gas 42. In a preferred embodiment of the present invention, perfluoropolyether 26 in lower chamber 25 comprises HC/R while perfluoropolyether 46 in chamber 45 comprises HC/04. The combination of low and high viscosity perfluoropolyethers and gas 42 advantageously cushion the impact of base 5 on ground 7 during use to reduce the impact felt by the wearer.

Figure 3:
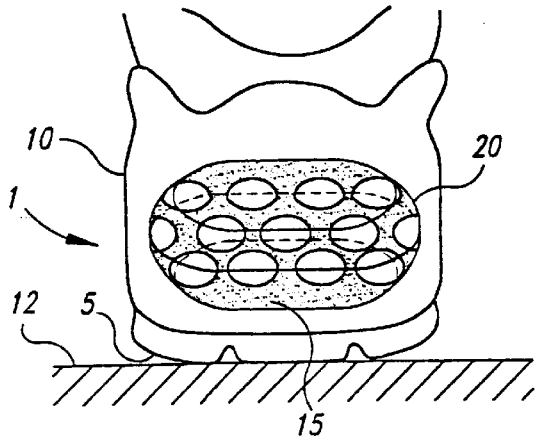
FIG. 3 is a rear view cutaway of a shoe containing a further representative embodiment of an insole of this invention.
Figure 4:
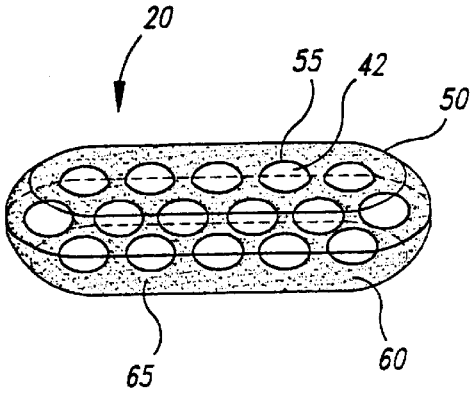
FIG. 4 is an isometric view of the insole of FIG. 3.

An alternate embodiment of the present invention is shown in FIGS. 3 and 4. The alternate embodiment includes a combination of gas and perfluoropolyether to advantageously cushion the wearer's foot. In the alternate embodiment, insole 20 comprises sac 22. Sac 22 contains interior sacs 55 which are filled with gas 42. The interstitial regions 60 located between interior sacs 55 are filled with high viscosity perfluoropolyether 65. In a preferred embodiment, perfluoropolyether 65 comprises HC/R, and gas 42 comprises a fluorocarbon (fully or partially substituted).

The present invention may be carried out in ways other than those set forth herein without departing from the spirit and essential characteristics of the invention. The present embodiments are, therefore, to be considered in all respects as illustrative and not restrictive and all changes come within the scope of the appended claims.

I claim:

1. A cushioning and impact-absorbing insole shaped to be placed in an article of footwear, the insole comprising an enclosed container having an interior volume containing a perfluoropolyether wherein the perfluoropolyether provides the impact-absorbing characteristics for a wearer.

2. The insole of claim 1 wherein the enclosed container comprises a first and a second interior volume, wherein the first interior volume contains a high-viscosity perfluoropolyether and the second interior volume contains a low-viscosity perfluoropolyether.

3. The insole of claim 2 wherein the enclosed container further comprises a third interior volume, wherein the third interior volume contains a gas.

4. The insole of claim 1 wherein the enclosed container comprises a first and a second interior volume, wherein the first interior volume contains the perfluoropolyether and the second interior volume contains a gas.

5. The insole of claim 1 wherein the enclosed container comprises a plurality of interior volumes containing the perfluoropolyether.

6. The insole of claim 1 wherein the enclosed container comprises a plurality of interior volumes containing a gas.

7. The insole of claim 1 wherein the enclosed container has a lower surface, an upper surface located opposite the lower surface, a lower dividing wall defining a lower chamber between the lower dividing wall and the lower surface, the lower chamber containing a high-viscosity perfluoropolyether, and an upper dividing wall defining an upper chamber between the upper dividing wall and the upper surface and defining a middle chamber between the upper dividing wall and the lower dividing wall, the upper chamber containing a low-viscosity perfluoropolyether and the middle chamber containing a gas.

8. An article of footwear of the type used for cushioning an impact on a wearer's foot during locomotion, the footwear comprising an enclosed container having an interior volume and wherein the interior volume contains a perfluoropolyether wherein the perfluoropolyether provides the impact-absorbing characteristics for the wearer.

9. The article of footwear of claim 8 wherein the article of footwear is an athletic shoe.

10. The article of footwear of claim 8 wherein the enclosed container is positioned in a heel of the article of footwear.

11. The article of footwear of claim 8 wherein the enclosed container comprises a first and a second interior volume, wherein the first interior volume contains a high-viscosity perfluoropolyether and the second interior volume contains a low-viscosity perfluoropolyether.

12. The article of footwear of claim 11 wherein the enclosed container further comprises a third interior volume, wherein the third interior volume contains a gas.

13. The article of footwear of claim 8 wherein the enclosed container comprises a first and a second interior volume, wherein the first interior volume contains the perfluoropolyether and the second interior volume contains a gas.

14. The article of footwear of claim 8 wherein the enclosed container comprises a plurality of interior volumes containing the perfluoropolyether.

15. The article of footwear of claim 8 wherein the enclosed container comprises a plurality of interior volumes containing a gas.

16. The article of footwear of claim 8 wherein the enclosed container has a lower surface, an upper surface located opposite the lower surface a lower dividing wall defining a lower chamber between the lower dividing wall and the lower surface, the lower chamber containing a high-viscosity perfluoropolyether, and an upper dividing wall defining an upper chamber between the upper dividing wall and the upper surface and defining a middle chamber between the upper dividing wall and the lower dividing wall, the upper chamber containing a low-viscosity perfluoropolyether and the middle chamber containing a gas.

17. The article of footwear of claim 8 wherein the enclosed container is integral to the footwear.

18. The article of footwear of claim 8 wherein the enclosed container is removable from the footwear.

19. A method of cushioning and absorbing impact in an article of footwear, comprising placing an insole containing a perfluoropolyether within the article of footwear wherein the perfluoropolyether provides the impact-absorbing characteristics for a wearer.

* * * * *